US005186038A

United States Patent [19]

Venalainen

[11] Patent Number: 5,186,038

[45] Date of Patent: Feb. 16, 1993

[54] RECTIFYING MEANS FOR A CAR BODY AND PROCEDURE IN RECTIFYING SAME

[75] Inventor: Teuvo O. Venalainen, Kuopio, Finland

[73] Assignee: Autorobot Finland Ky, Finland

[21] Appl. No.: 741,420

[22] PCT Filed: Nov. 28, 1990

[86] PCT No.: PCT/FI90/00289

§ 371 Date: Jul. 30, 1991

§ 102(e) Date: Jul. 30, 1991

[87] PCT Pub. No.: WO91/08063

PCT Pub. Date: Jun. 13, 1991

[30] Foreign Application Priority Data

Dec. 1, 1989 [FI] Finland ..... 895748

[51] Int. Cl.[5] ..... B21D 1/12

[52] U.S. Cl. ..... 72/457; 72/705

[58] Field of Search ..... 72/447, 457, 705

[56] References Cited

U.S. PATENT DOCUMENTS 4,281,532 8/1981 Covington ..... 72/705

4,289,016 9/1981 Hare ..... 72/705

FOREIGN PATENT DOCUMENTS 0065942 12/1982 European Pat. Off. .

0250344 12/1987 European Pat. Off. .

0269538 6/1988 European Pat. Off. .

2145992 3/1973 Fed. Rep. of Germany .

2420248 11/1975 Fed. Rep. of Germany .

8707191 12/1987 World Int. Prop. O. .

*Primary Examiner*—Lowell A. Larson

*Attorney, Agent, or Firm*—Steinberg & Raskin

[57] ABSTRACT

The invention relates to a car body rectifying means (10), comprising a rectifying table (11) to which a vehicle (A) can be attached with the attachments (12) of the rectifying table (11). The rectifying means (10) comprises a rectifying unit (15) secured to the rectifying table (11), comprising a base frame (16) and a slide unit (17) movable relative thereto. The slide unit (17) comprises a rectifying boom (19) turnable about a vertical axis (Z) moving along with the slide unit (17), said rectifying boom (19) being securable in optional positions relative to the slide unit (17). The invention also relates to a procedure in car body rectifying.

17 Claims, 5 Drawing Sheets

RECTIFYING MEANS FOR A CAR BODY AND PROCEDURE IN RECTIFYING SAME

Figure 1:
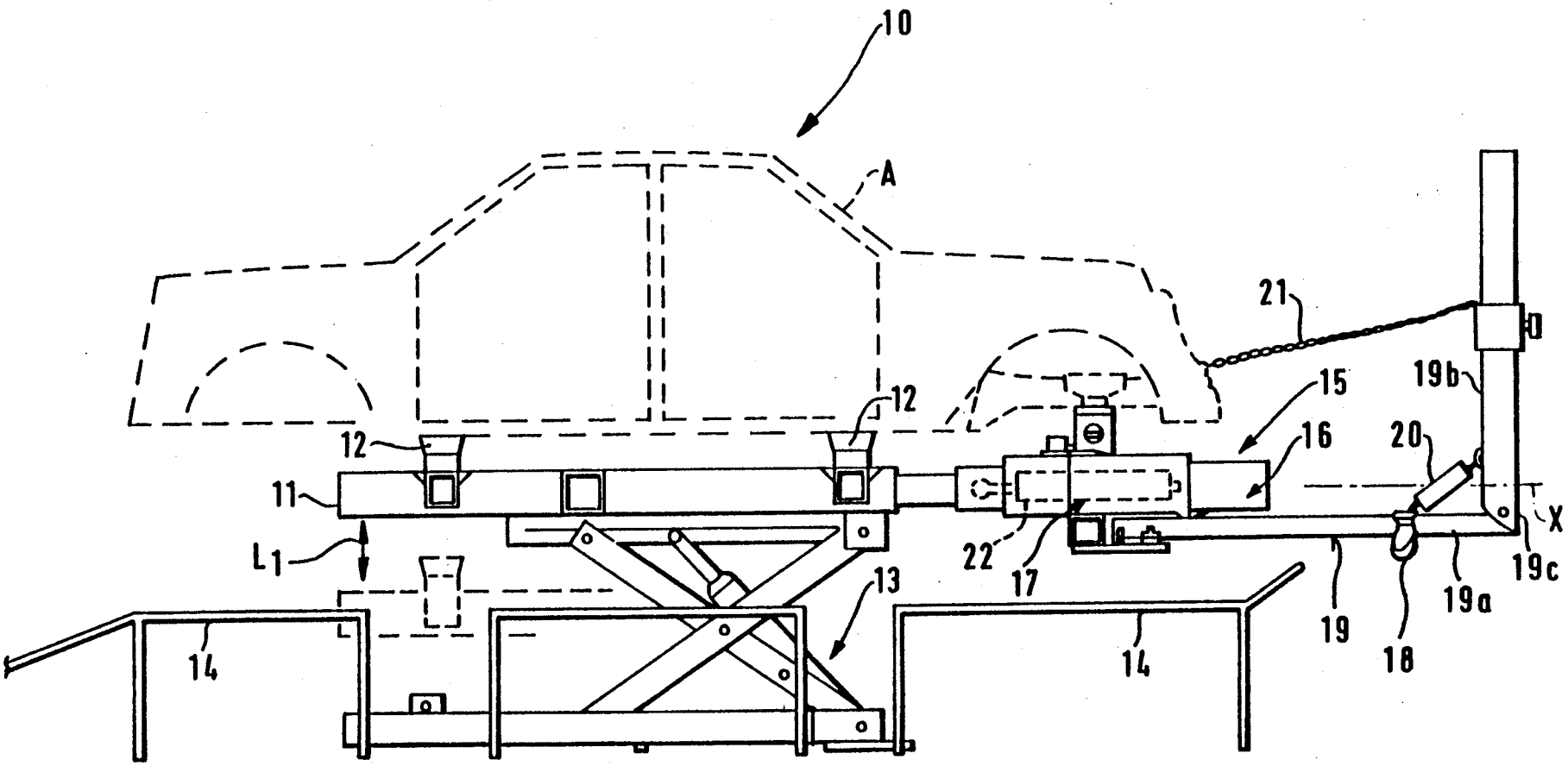

The invention relates to a car body rectifying means and a procedure in car chassis rectifying.

Such car chassis rectifying means are known in the art in which the car is driven to a rectifying table and fixed to the skirt attachments of the rectifying table and is thereafter lifted to the desired height position. The car body rectifying operation is further accomplished using separate support arms, pulling halters, or equivalent by applying a force to said rectifying tools and directing it at the object to be rectified. In the Finnish patents Nos. 59 348 and 53 930 of the same applicant rectifying means are disclosed in which the force can be directed in desired direction on the object to be rectified. Similarly, through the earlier Finnish patent No. 862265 of the same applicant is known a car body rectifying means in which a separate rectifying unit can be attached to the rectifying table. The design of the Finnish patent application No. 862265 allows the rectifying to be carried out on the understructure of the car, as well as rapid and flexible transfer of the power to the objects to be rectified. The object of the present invention is an improvement regarding particularly the means design of the Finnish patent No. 862265.

It has been understood in the invention to provide a rectifying unit to be attached to the rectifying table which comprises a slide unit and a semicircular plate in fixed position on the slide unit, the rectifying boom of which, turnable to engage with receptacle notches can be fixed in optional positions. The rectifying boom can be turned 180° around the vertical axis. As taught by the invention, a turnable rectifying boom positioned on the end of the rectifying unit is used which comprises a horizontal beam section and a vertical beam section, said vertical beam section being pivoted to be rotatable in the vertical plane, whereby the force can by means of an action between the horizontal beam section and the vertical beam section be directed from the turnable vertical beam further on to the object to be rectified on the car body. As taught by the invention, the rectifying means comprises a slide unit which can be moved, using a separate action means, preferably a hydraulic cylinder, in horizontal direction and preferably in the direction of the central axis X of the rectifying table. The slide unit comprises box beams which can be moved, directed by beams parallelling the central, or X axis of the base frame of the rectifying unit. The slide unit can be secured in optional positions to the beams of the base frame of the rectifying unit.

Furthermore, the slide unit of the rectifying means comprises a beam section in the Y direction at right angles to the beam sections in X direction and to which a separate support arm or directly a tool can be fixed.

Therefore, the slide unit can be moved parallel to the central axis X of the rectifying table. The tool or support arm mounted on the slide unit can moreover be moved at right angles to the X axis, that is, in the direction of the Y axis. Consequently, the rectifying unit of the invention can be applied with ease, and rapidly to carry out the rectifying of the understructures of the car body as well as the superstructures of the car body using an L shaped rectifying boom, turnable through 180°, connected to the slide unit.

With the means of the invention a counter force can be transmitted to the opposite side of the object to be rectified, by using a rectifying boom turnable through 180° and an additional support arm on the slide unit, and by keeping the slide unit in a non-secured state. A counter-force is then directed through the pull halter attached to an additional support arm connected to the slide unit on other side of the point to be rectified, whereby the body area on the other side of the point to be rectified can be kept stationary.

The car body rectifying means of the invention is mainly characterized in that the rectifying unit comprises a base frame and a slide unit movable relative thereto, an actuator being provided, for moving said slide unit taking place around the longitudinal axis of the rectifying table, and said slide unit comprising a rectifying boom turnable in the direction of a vertical axis moving along with the slide unit, said rectifying boom being securable in optional positions relative to the slide unit, and that an actuating means is provided with the aid of which a rectifying force is directed from the beam structure of the rectifying boom on the object to be rectified.

The procedure of the invention in rectifying a car body is mainly characterized in that the slide unit is kept freely movable relative to the base frame, and that by operating the actuating means of the rectifying boom turnable about a vertical axis connected to the slide unit, a force is directed on the object to be rectified of the vehicle to be rectified, and that in the procedure at least one further support arm is used which is connected to the movable slide unit, a force being directed with the aid of said further support arm on the opposite side of the object to be rectified, whereby with said arrangement a counterforce is directed on the vehicle being rectified.

The invention is described below referring to a number of preferred embodiments presented in the figures of the accompanying drawings, to which the invention is not, however, intended to be exclusively confined.

FIG. 1 presents the car body rectifying means in elevational view, partly in schematic representation.

Figure 2:
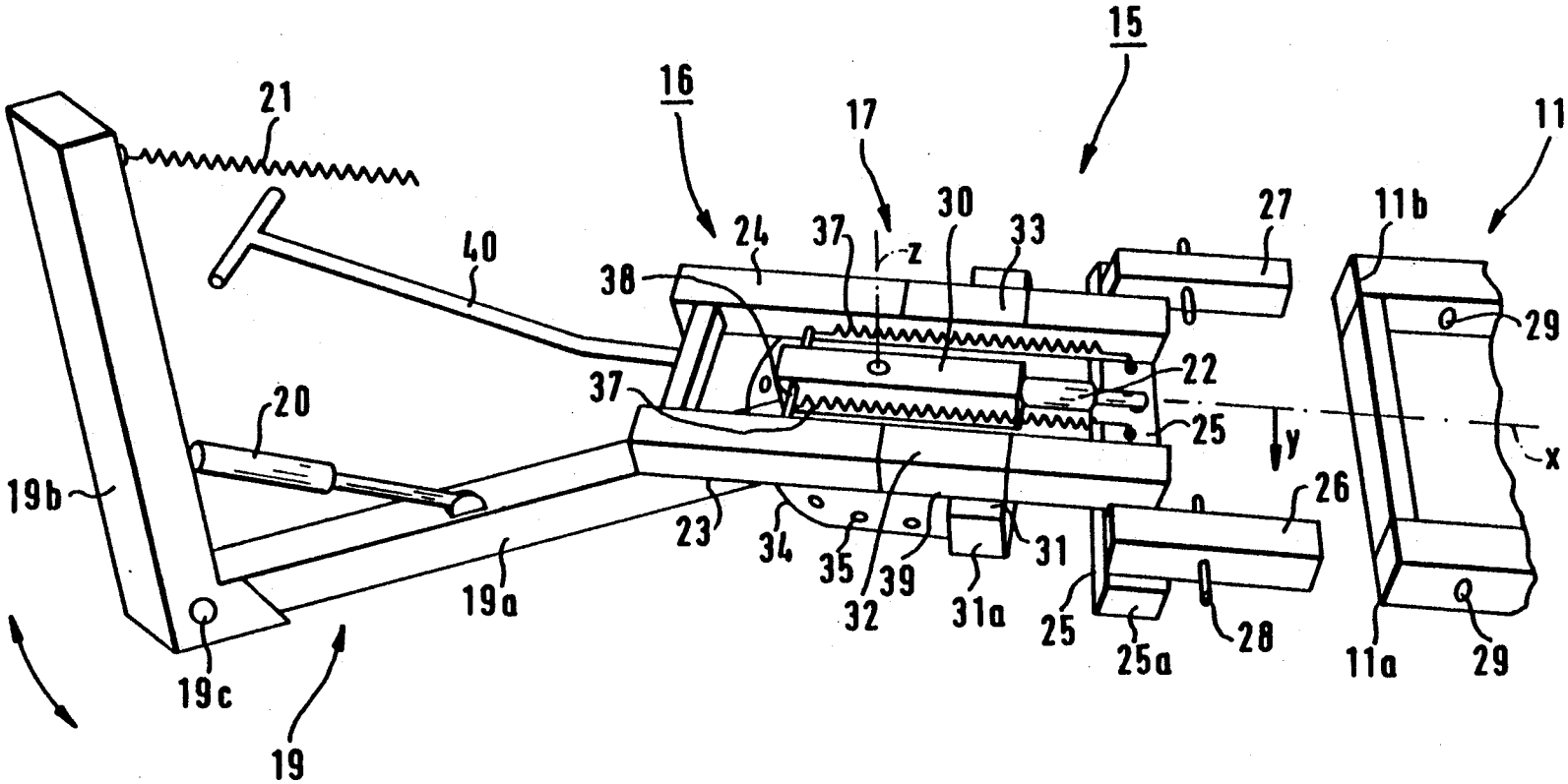

FIG. 2 presents in axonometric view the rectifying unit to be connected to the rectifying table.

Figure 3:
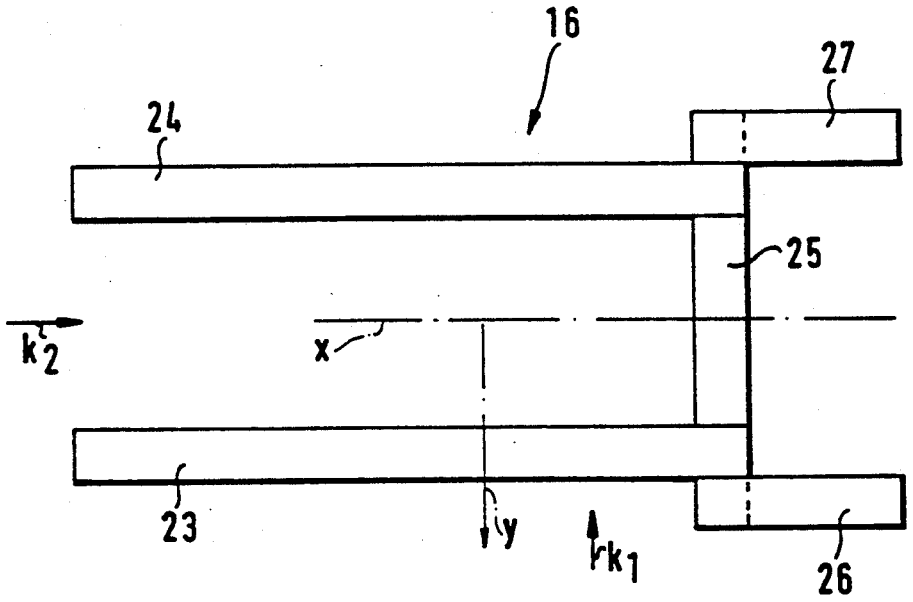

FIG. 3 presents the base frame of the rectifying unit of FIG. 2 in top view.

Figure 4:
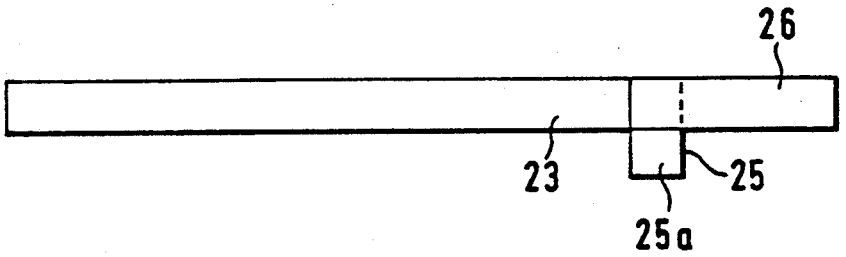

FIG. 4 presents the base frame design of FIG. 3 in the direction of arrow $K_1$ in FIG. 3.

Figure 5:
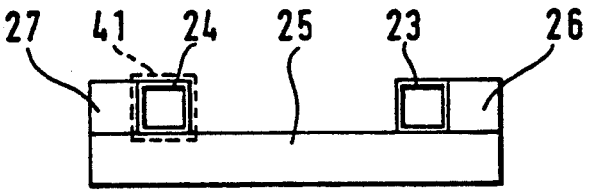

FIG. 5 presents the base frame of the rectifying unit of FIG. 3 as viewed in the direction of arrow $K_2$ in FIG. 3.

Figure 6:
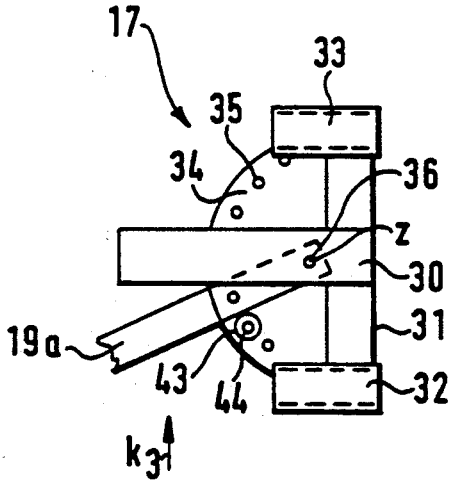

FIG. 6 presents a slide unit of the rectifying unit movable with a cylindrical means connected to the base frame.

Figure 7:
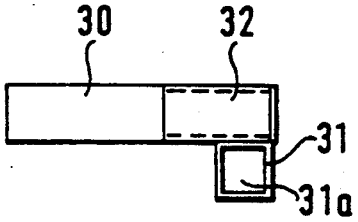

FIG. 7 presents a slide unit of FIG. 6 as viewed in the direction of arrow $K_3$ in FIG. 6.

Figure 8:
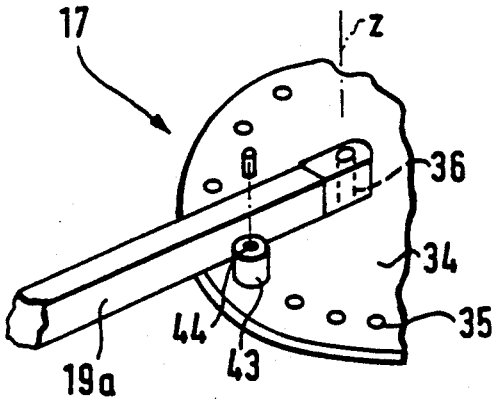

FIG. 8 presents the securing of the turnable rectifying boom of the slide unit to a plate moving along with the slide unit.

Figure 9:
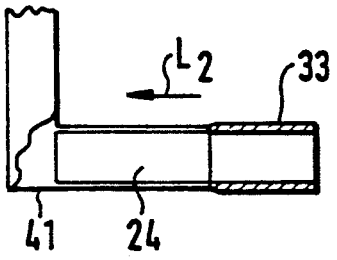

FIG. 9 presents the use of an additional rectifying boom.

Figure 10:
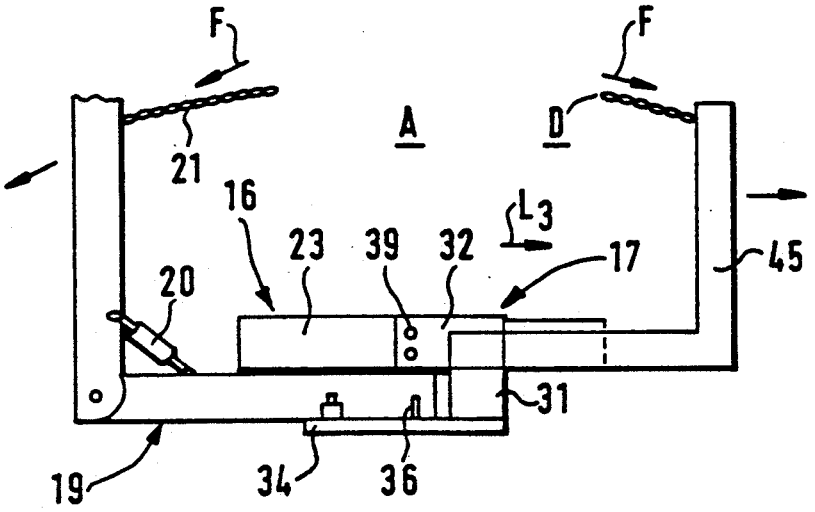

FIG. 10 presents the carrying out of counterpulling in the object to be rectified.

Figure 11:
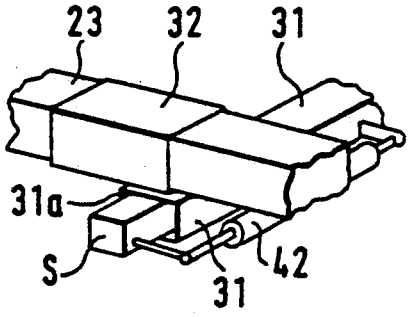

FIG. 11 presents a use of a cylindrical means in said slide unit for carrying out elevational car rectifying.

FIG. 1 presents the car body rectifying means 10 of the invention. A vehicle A has been secured to the rectifying table 11 of the rectifying means 10, to the skirt attachments 12 thereof. The rectifying table 11 can be lifted using a lifting means to desired rectifying height. When carrying out the rectifying operation, the drive plates 14 can be moved aside.

As taught by the invention, the rectifying unit 15 has been connected to the rectifying table 11 so that the rectifying unit 15 can be lifted and lowered along with the rectifying table 11. A rectifying force can through the rectifying unit 15 be directed on the object to be rectified of the vehicle.

In FIG. 1 is partly schematically shown the rectifying unit 15. The rectifying unit 15 comprises a base frame 16, relative to which a slide unit 17 has been arranged to move. With the aid of wheels 18 the rectifying unit 15 can be moved to be in association with the rectifying table 11. The apparatus comprises furthermore a rectifying boom 19 rotatable about a vertical axis Z. The very slide unit 17 can be moved in the direction of the central axis and the longitudinal axis X of the rectifying table with the aid of an actuator depicted with dot and dash line in the figure, this being preferably a cylindrical means 22.

The turnable rectifying boom 19 moves along with the slide unit 17. The rectifying boom 19 is an L beam structure comprising a horizontal beam section 19*a* and a beam section 19*b* vertically located thereto. The vertical beam section 19*b* is turnable about a hinge 19*c*, or in vertical plane. The turning operation can be carried out with an actuator 20, preferably a hydraulic cylinder. A force can therefore be directed, by turning the beam section 19*b*, through the pull halter 21 on the object to be rectified on the car body.

The rectifying unit 15, being affixed to the rectifying table 11, can be lifted and lowered with the aid of a lifting means 13.

FIG. 2 presents the rectifying unit of the invention in axonometric view. The rectifying unit 15 comprises a base frame 16. The base frame 16 comprises box beams 23 and 24 as well as a transversal beam 25 placed at right angles thereto. Connecting beams 26 and 27, being in the direction of the X axis, are connected to the transversal beam 25, wherefrom the base frame 16 can be connected to the frame beams 11*a* and 11*b* of the rectifying table 11. The connecting beams 26 and 27 are arranged to be inside the beams 11*a* and 11*b* of the rectifying table 11.

The base frame 16 can with a cotter pin 28 be detachably connected to the rectifying table 11, said cotter pin 28 being inserted, while being connected, in the receptacle notches 29 of the beams 11*a*, 11*b*.

The rectifying unit 15 comprises further a slide unit 17 movable relative to the base frame 16 with an actuator 22, preferably with a hydraulic cylinder.

The slide unit 17 comprises a centre beam 30 in the X direction, inside which the cylinder 22 serving as the actuator has partly been inserted. The cylinder 22 has at the other end been affixed in fixed position on the transversal beam 25 on the base frame 16.

The box-type centre beam 30 of the slide unit 17 in the X direction has been connected to a transversal beam 31. The transversal beam 31 has furthermore been connected to a first and second box beam 32,33 in the X axis direction, said box beams 32 and 33 being arranged to encompass the beams 24 and 23 in the X direction of the base frame 16 of the rectifying unit 15. Therefore, the slide unit 17 of the rectifying unit 15 movable with the actuator 22 is directed by the beams 23 and 24 of the base frame 16.

A plate 34 has furthermore been attached to the transversal beam 31 of the slide unit 17, on its undersurface, comprising a plate sector of the order of 180°, and with receptacle notches 35 therein, in which the turnable rectifying boom 19 can be secured with a cotter pin or equivalent.

The rectifying boom 19 can be turned about a vertical Z axis in an axle pin 36 affixed in the middle of the plate 34. Receptacle notches 35 are provided on the plate 34 at regular division, so that the rectifying boom 19 is attachable in an angular position determined by the division.

The slide unit 17 is moved by the above actuator 22, preferably a hydraulic cylinder. As shown in FIG. 2, said actuator is a single-purpose cylinder, its return movement being effected by means of springs 37 shown in the figure. The cylinder 22 has at one end connected to the transversal beam 25 of the base frame 16, and at the other end, to the centre beam 30 of the slide unit 17. When the cylinder 22 is affected, the slide unit 17 is moved in the direction demonstrated by arrow $L_2$, and when the influencing on the slide unit is terminated, the springs 37 return the slide unit 17 to its original position. The springs 37 have at one end been affixed to the transversal beam 25 of the base frame 16, and at the other end, to the movable centre beam 30 of the slide unit 17. An axle 38 has preferably been taken through the centre beam 30, on which one end of the spring 37 has been affixed, as well as the cylinder 22. The springs 37 may also be omitted if a double-acting cylinder 22 is used.

The slide unit 17 is relative to the base frame 16 securable with screws 39. The screws 39 have been taken through the beams 32 and 33 of the slide unit, and they can be secured to the beams 23 and 24 in the X axis direction of the base frame 16.

The rectifying unit 15 shown in FIG. 2 is furthermore provided with wheels 18, supported by which the means can be displaced by pushing at a handle 40 to be in conjunction with the rectifying table 11 of the rectifying means 10.

FIG. 3 presents the base frame 16 of the rectifying unit 15 of the invention in top view. The means is symmetrical relative to the central axis X. As shown in FIG. 3, the beams 23 and 24 in the X axis direction of the base frame 16 have at their ends been connected to the transversal beam 25, to the ends whereof connecting beams 26 and 27 have been furthermore connected.

FIG. 4 presents the apparatus of FIG. 3 in elevational view. The transversal beam 25 is a box beam, and therefore, a separate rectifying end or a support arm, or another tool inserted in the inside volume 25*a* of the box beam 25 can be positioned, this being movable with a separate cylindrical means in the Y axis direction.

FIG. 5 presents the base frame 16 of the rectifying unit of the invention in end view. The longitudinal beams 23 and 24 in the X axis direction are preferably rectangular or square in cross-section. In the figure is depicted with a broken line a separate rectifying end, this being placeable around the beam 23 and/or 24. By moving the slide unit 17 with the actuator 22, a separate rectifying boom 41 is moved at the same time, said boom being directed from the beam 24 of the base frame 16. The beam 33 of the slide unit 17 of the rectifying unit 15 moves said separate rectifying boom 41.

Therefore, with the means of the invention, the rectifying boom 19 turnable about the Z axis can at the same time be operated with the actuator 20 thereof, and at the same time, with the actuator 22 the slide unit 17 and the rectifying boom 41 connected to the end of the beam 32 thereof can be moved. Thus, the means of the invention allows several operational variations.

FIG. 6 presents the slide unit 17 movable relative to the base frame 16 of the rectifying unit 15. The slide unit 17 is presented in top view. To the centre beam 30 is connected a transversal beam 31 and furthermore, the box beams 32 and 33 of the centre beam 30 in the direction of the longitudinal axis are connected to the ends of the transversal beam 31, said beams being in use arranged to move along with the beams 23 and 24 of the base frame 16, and therearound. As presented in FIG. 6, the slide unit 17 comprises a plate 34 which is a locking plate and secured to the underside of the beam 31. The plate is provided with receptacle notches 35 serving as attachment points for the turnable rectifying end 19.

The plate 34 is preferably a 180° semicircular plate, provided with receptacle notches 35 at the division at which the turnable rectifying boom 19 is wished to be secured.

The rectifying boom 19 has been articulated to turn about a vertical Z axis in the axle pin 36 on top of the plate 34.

FIG. 7 presents the slide unit shown in FIG. 6 in elevational view. The transversal beam 31 is preferably a box beam in the inner space 31*a* of which a separate rectifying end, a support arm, or equivalent can be inserted. The tool can be secured on the transversal beam 31 in a fixed position, or, being moved into the beam 31, directed thereby, with a separate cylindrical means 42 (FIG. 11) placed between the beam 31 and the tool.

FIG. 8 presents in axonometrical partial view the turnable rectifying end 19 of the invention connected to the slide unit 17, moving the pull halter 21. The horizontal beam 19*a* of the rectifying end 19 has been pivoted to turn about a vertical axis Z supported by an axle pin 36 affixed to the plate 34. The rectifying end 19 comprises further a receptacle 43 in the horizontal beam 19*a*, through the hole 44 of which a cotter pin or an equivalent securing component can be so positioned that it is at one end inserted into one of the receptacle notches 35 of the plate 34, whereby the securing takes place between the plate 34 and the boom 19.

FIG. 9 presents an additional rectifying end 41 placed around the beam 24, which the beam 33 of the slide unit 17 has been arranged to move in the direction of arrow $L_2$. The presentation of the figure is axonometric and partly principal.

With the means of the invention, it is ideal to change the rectifying direction by using both the actuator 22 and the actuator 20 at the end of the rectifying boom 19 simultaneously.

FIG. 10 presents the counterpulling with the means of the invention. The presentation is principal. Via the pull halter 21 the force of the cylinder 20 is transmitted to the object to be rectified, whereby the slide unit 17 moves in the direction indicated by arrow $L_3$ and the additional rectifying end 45 connected to the slide unit directs a counterpulling operation on the object D on the car, said object D being kept stationary throughout the rectifying operation.

FIG. 11 presents schematically how a tool S in the beam 31 of the slide unit 17 is moved with the cylindrical means 42. The cylinder 42 has at one end been connected to the transversal beam 31 of the slide unit 17 and at the other end, to the tool S. The tool S can therefore be moved at right angles relative to the X axis, that is, in the elevational direction of the car A to be repaired.

I claim:

1. A car body rectifying means, comprising a rectifying table, attachments for holding an object to be rectified, said attachments being located on said rectifying table, lifting means structured and arranged to lift and lower said rectifying table, a rectifying unit connected to said rectifying table, said rectifying unit comprising a base frame and a slide unit, said slide unit being freely movable relative to said base frame, a first actuator located on said base frame, said first actuator being structured and arranged to move said slide unit along a horizontal axis of said rectifying table, and said slide unit comprising a rectifying boom having a beam structure, said rectifying boom being turnable about a vertical axis of said rectifying table and being movable along with said slide unit, said rectifying boom being securable by securing means in optional positions relative to said slide unit, and a second actuator provided on said rectifying boom, said second actuator directing a rectifying force from said beam structure of said rectifying boom to the object to be rectified.

2. A car body rectifying means according to claim 1, wherein said rectifying boom comprises a horizontal beam and a vertical beam, said vertical beam being movable in a vertical plane with the aid of said second actuator, said vertical beam being pivotable at a hinge point to said horizontal beam, and said second actuator being connected between said horizontal beam and said vertical beam.

3. A car body rectifying means according to claim 2, further comprising a plate connected to said slide unit, said horizontal beam of said rectifying boom being pivotable to turn relative to said plate about a vertical axis, said rectifying boom and said plate comprising interactional means for securing said rectifying boom to said plate.

4. A car body rectifying means according to claim 3, wherein said plate is a 180° semicircular plate.

5. A rectifying means according to claim 3, wherein said plate comprises receptacle notches, said rectifying means further comprising a cotter pin arranged through a hole in said horizontal beam of said rectifying boom, said cotter pin being inserted into one of said receptacle notches of said plate, such that said rectifying boom is securable in optional positions along a 180° sector, and said rectifying boom is movable from a position in a horizontal axis of said horizontal beam to an angular position in the direction of an axis at right angles to the horizontal axis.

6. A car body rectifying means according to claim 5, wherein said rectifying boom has been arranged to turn about an axle into various angular positions about the vertical axis.

7. A rectifying means according to claim 1, wherein said slide unit comprises a center beam, and said first actuator is a cylindrical means which has partly been inserted into said center beam, said first actuator having a first end and a second end , at said first end of said first actuator being affixed on said center beam and said second end of said first actuator being affixed on said base frame.

8. A car body rectifying means according to claim 1 wherein said base frame having a beam structure, said slide unit comprises a center beam, a transversal beam connected to said center beam, box beams being connected to said center beam, said box beams being positioned around beams of said base frame, whereby said slide unit is directed by said beams of said base frame.

9. A car body rectifying means according to claim 8, wherein said rectifying means comprises an additional rectifying boom, said additional rectifying boom being positioned around one of said beams of said base frame in the horizontal axis direction, and said additional rectifying boom being directed therefrom and moved with the aid of said slide unit when an end of one of said box beams pushes said additional rectifying boom forward as the moving is carried out with said first actuator.

10. A car body rectifying means according to claim 9, wherein said rectifying boom, said slide unit and said additional rectifying boom are structured and arranged such that said rectifying boom is turnable about the vertical axis via said second actuator at the same time said slide unit and said additional rectifying boom are movable along the horizontal axis via said first actuator.

11. A car body rectifying means according to claim 1, further comprising cylindrical means connected at a first end to said slide unit and said cylindrical means being connected at an opposite end to a tool, said slide unit comprising a transversal beam having an inner space, said tool being movable via said cylindrical means in the inner space of said transversal beam to obtain a horizontal rectifying movement at right angles to the horizontal axis, whereby an elevational rectifying movement can be provided on the car body.

12. A car body rectifying means according to claim 11, wherein said cylindrical means being connected at one end to said transversal beam on said slide unit and at an opposite end to said tool.

13. A car body rectifying means according to claim 1, wherein said first actuator is a cylinder means.

14. A car body rectifying means according to claim 1, further comprising a handle and wheels connected to said rectifying unit, said rectifying unit being displaceable by moving said handle in conjunction with said rectifying table.

15. A car body rectifying means according to claim 1, wherein said rectifying boom and said slide unit are structured and arranged such that said rectifying boom is turnable about the vertical axis via said second actuator at the same time said slide unit is movable along the horizontal axis via said first actuator.

16. A method for car body rectifying, comprising affixing a vehicle to skirt attachments of a rectifying table, lifting the vehicle to a rectifying height, connecting a separate rectifying unit to said rectifying table, said rectifying unit comprising a fixed base frame and a slide unit, such that said slide unit is freely movable relative to said fixed base frame via an actuator, operating actuating means located on a rectifying boom of said rectifying table, said rectifying boom being turnable about a vertical axis and connected to said slide unit, directing a force on the object to be rectified on the vehicle by means of said rectifying boom, and directing a force on the opposite side of the object to be rectified by means of at least one further support arm connected to said slide unit, whereby with said arrangement a counterforce is directed on the object on the vehicle being rectified.

17. The method of claim 16, wherein said actuator is a cylinder means.

* * * * *